US007328575B2

(12) United States Patent
Hedman

(10) Patent No.: US 7,328,575 B2
(45) Date of Patent: Feb. 12, 2008

(54) METHOD AND DEVICE FOR THE PNEUMATIC OPERATION OF A TOOL

(75) Inventor: Mats Hedman, Sparreholm (SE)

(73) Assignee: Cargine Engineering AB, Stockholm (SE)

( * ) Notice: Subject to any disclaimer, the term of this patent is extended or adjusted under 35 U.S.C. 154(b) by 62 days.

(21) Appl. No.: 10/556,407

(22) PCT Filed: May 19, 2004

(86) PCT No.: PCT/SE2004/000783

§ 371 (c)(1),
(2), (4) Date: Nov. 10, 2005

(87) PCT Pub. No.: WO2004/104417

PCT Pub. Date: Dec. 2, 2004

(65) Prior Publication Data

US 2006/0272324 A1 Dec. 7, 2006

(30) Foreign Application Priority Data

May 20, 2003 (SE) ..... 0301457

(51) Int. Cl.
*F04B 49/00* (2006.01)
*F15B 11/06* (2006.01)

(52) U.S. Cl. ..... 60/407; 60/456

(58) Field of Classification Search ..... 60/407, 60/412, 456; 92/144
See application file for complete search history.

(56) References Cited

U.S. PATENT DOCUMENTS

| | | | | |
|---|---|---|---|---|
| 3,398,533 A * | 8/1968 | Wolfbauer, Jr. | ..... | 60/407 |
| 6,752,106 B2 | 6/2004 | Hedman | | |
| 2003/0150415 A1 | 8/2003 | Hedman | | |

FOREIGN PATENT DOCUMENTS

| | | | |
|---|---|---|---|
| GB | 190800449 | * | 0/1909 |
| SE | 520993 | | 9/2003 |

* cited by examiner

*Primary Examiner*—Thomas E. Lazo
(74) *Attorney, Agent, or Firm*—Young & Thompson

(57) ABSTRACT

A device for the pneumatic operation of a tool includes a generally closed pressure fluid circuit (2), at least one compressor (5), for increasing the pressure of the pressure fluid in the circuit, the compressor (5) having an inlet and an outlet, and a tool driven by the pressure fluid in the circuit, and through which the pressure fluid is transported in the circuit from the outlet to the inlet of the compressor (5). The pressure that is generated by the compressor and the load adopted by the tool (8) are adapted such that the pressure of the returning pressure fluid downstream the tool (8) is higher than the pressure of the surrounding atmosphere.

17 Claims, 4 Drawing Sheets

METHOD AND DEVICE FOR THE PNEUMATIC OPERATION OF A TOOL

FIELD OF THE INVENTION

The present invention relates to a method for the pneumatic operation of a tool.

The invention also relates to a device for the implementation of the method.

The invention is applicable at all kinds of pneumatic devices, such as engines and tools that are operated by means of air or any other gas. Tool, as it is referred to here, should be regarded in a wide sense, including devices for any industrial use, for the pneumatic operation of vehicles, for pneumatically activated actuators for engine valves, all types of working tools etc.

"Generally closed" is referred to as a circuit that is as closed as possible, that is a circuit by which there is a continuous pressure fluid conduit from the outlet of the compressor, through the operated tool to the inlet of the compressor. Preferably, such a circuit is free from deliberately arranged passages through which the pressure fluid could leak out to the surrounding atmosphere.

THE BACKGROUND OF THE INVENTION

Pneumatic systems normally comprise a compressor for the compression of a fluid, air or any other gas, and a tank in connection with the compressor, and a conduit for guiding the fluid to one or more user places. Normally, the user place is an air-operated member such as an air-operated tool or an air-operated engine.

Upon the compression of air heat is generated, which in contemporary pneumatic systems, normally and generally, is transferred to the environment already before the air has reached the user place. It should be mentioned that in connection to so-called adiabatic compression (without any heat exchange with the environment, and here regarded as relevant for piston compressors, which is, a common type of compressor in this context) of air that has a temperature of 300 K and a pressure of 1 bar absolute up to 10 bar absolute, the final temperature is approximately 579 K. The volume of the air at the user site, that is by the tool has decreased with $(1-{}^{300}/_{579})\times 100\%=48\%$ if the temperature at the user site has decreased to 300K. Normally, the transfer of heat to the environment is only a large loss of energy. Occasionally, the compression heat is taken advantage of for the purpose of water heating, resulting in a substantial improvement of the total economy. However, the size of the plant, that is the size of the compressor, and the capacity thereof remain the same. Furthermore, the tank that is used for the storage of air, as well as the air conduit, may be insulated to a certain degree, which is also positive for the reduction of the consumption of energy. The compressor and the tank are dimensioned with regard to the need of air at the user site and the heat losses.

There are also other losses, but the far most important source of loss is constituted by said heat loss. The heat loss effects the energy efficiency negatively. An excessive amount of energy is required for the operation of a compressor for supplying, for example, pressurised air to a tool of a certain power.

THE OBJECT OF THE INVENTION

The object of the invention is to provide a method and a device to satisfy the need of pressure fluid, air or other gas for the operation of a tool while, simultaneously, the heat losses appearing in the circuit are minimized.

It is a further object of the invention to provide a method and a device that permits the use of the compressor with a relatively low capacity, that is a low consumption of air energy, for the operation of a specific tool.

SUMMARY OF THE INVENTION

The invention is based on the conclusion that, if the required pressure fluid is generated through compression without the contemporary temperature increase, the heat losses can be reduced to a corresponding degree, and the compressor can be made substantially smaller, which in many cases is of important advantage.

According to the present invention, the temperature increase by the compressor becomes very small as the compression is performed from an elevated pressure, higher than the pressure of the surrounding atmosphere, resulting in remarkably small heat losses for a particular absolute pressure increase. One condition is that the environment in which a conduit conducts the pressure fluid from the compressor to the tool has a certain maximum temperature which is lower than the temperature that the pressure fluid would have upon compression from atmospheric pressure up to the required pressure. Furthermore, the length of the conduit should be such that it causes heat exchange that would normally lower the temperature of the pressure fluid to the temperature of the surrounding. A realisation of the invention results in a remarkably lower compression temperature, temperature of the compressed gas, resulting in the potential for heat losses decreasing and the potential for heat supply increasing.

In order to obtain a useful work out of a pneumatically operated tool there is required a high pressure source and a low pressure source. In todays systems, the low pressure source is constituted by the surrounding atmosphere, with a pressure of approximately 1 bar. The high pressure source is obtained as air from the atmosphere is compressed to a certain pressure, for example 10 bar as in the following example. A pneumatic tool is driven by the difference between the high pressure source and the low pressure source, in this case approximately 9 bar. If the low pressure source would be for example 11 bar and the high pressure source would be 20 bar, then there would be the same pressure difference. The temperature increase upon compression from 1 bar to 10 bar is substantially larger than upon compression from 11 to 20 bar. Accordingly, in the latter case, the potential for heat losses is substantially smaller as the temperature increase upon compression becomes remarkably low. The pressure ratio, that is the relation between the high pressure source and the low pressure source, is small in the latter case (20/11) in comparison with the first case (9/1). The smaller pressure ratio (30/21), 40/31) etc, the less becomes the temperature increase. While the potential for heat losses is reduced due to a relatively low temperature after the compression, the potential for heat supply increases.

When the device is provided at or includes a combustion engine or other heat-generating component that, upon operation, has a temperature that is higher than the temperature of the surrounding atmosphere, a heat exchanger is, advantageously, arranged along the part of the pressure fluid conduit that extends between the compressor and the tool, for the purpose of transferring heat from said combustion engine or heat-generating component to the pressure fluid for a further reduction of the heat losses, or even for heating of the pressure fluid.

Further features and advantages of the method and device according to the invention are presented in the following, detailed description.

Fluid as referred to above or hereinafter, alone or as a part of another word, is a gas or gas mixture, preferably air.

In contemporary compressor arrangements for the operation of a tool, the air is normally taken from the atmosphere and compressed to a final pressure in the range of 6 to 10 bar absolute. When the air has been used for the operation of a tool, it is returned to the atmosphere. According to the invention, the air should not be returned to the atmosphere, but, instead, it should be returned in a closed system to the compressor. It is characterising for the invention that the returning air should have a pressure that exceeds the pressure of the atmosphere. As a result thereof, the air at the compressor should be compressed to a higher pressure than, by an open system with return of air to the atmosphere, would be necessary for operating a certain tool in order to obtain a required amount of work by means of the tool. According to the invention, a leakage of air from the closed system is compensated with air from the atmosphere or from a reservoir. Below, the advantages are shown by means of an example.

In the following example of the invention, it is shown how the potential for heat losses can be reduced to a remarkable degree. An adiabatic compression of atmospheric air of 1 bar absolute and a temperature of 300 K to the pressure of 10 bar absolute, that is a pressure difference of 9 bar, results in a final temperature of approximately 579 K. The potential for heat losses up to the user site, having the surrounding temperature of 300 K, is 579 minus 300, that is 279 degrees. In a closed system according to the invention, where the air pressure is 11 bar absolute and the temperature is 300 K before the adiabatic compression up to 20 bar absolute, that is a pressure difference of 9 bar, a final temperature of approximately 356 K is obtained. The potential for heat losses up to the user site is 356-300, that is 56 degrees. In the first case, the temperature becomes 279 degrees higher than the temperature of the environment, and in the latter case it becomes 56 degrees higher. The latter, inventive case results in a remarkably lower potential for heat losses to the environment. Simultaneously, the potential for heat supply increases. According to this example, heat sources with a temperature of more than 356 K can be used for the purpose of increasing the temperature in the air compressed to 20 bar. This, in its turn, results in a volume increase which means that a smaller amount of air of 20 bar must be produced for a certain need, in its turn resulting in a decreased need of compressor work.

By the implementation of the invention, piston compressors may be substituted by smaller, for example rotating compressors with better flow capacity but operating with a low compression ratio for the purpose of maintaining the efficiency at a reasonable level. The required displacement decreases with an increased return pressure, in its turn resulting in less friction and less heat-transferring surfaces. Preferably, waste heat or any other heat source is used for heating the air, or at least minimizing the cooling thereof, before it is supplied to the working tool. Then, also a cooling of the fluid before the compression is needed. Advantageously, heat is regained from the return air before the latter is finally cooled before the compression thereof (if the temperature is higher than after the compression, which could be the result of to much heat being supplied from the heat source upstream the tool) and before any heat is supplied from the heat source. With this heating and cooling there is presented a pneumatic energy transformer, and more work is produced by, for example, a working tool or an expander than supplied by the compressor, thanks to the external supply of heat. In a closed system, the need of removal of condenser water is minimized.

Further advantages and features of the invention will be presented in the following, detailed description and in the remaining dependent patent claims.

BRIEF DESCRIPTION OF THE DRAWINGS

Hereinafter, the invention will be described more in detail, by way of example, with reference to the annexed drawings, on which.

DETAILED DESCRIPTION OF PREFERRED EMBODIMENTS

Figure 1:
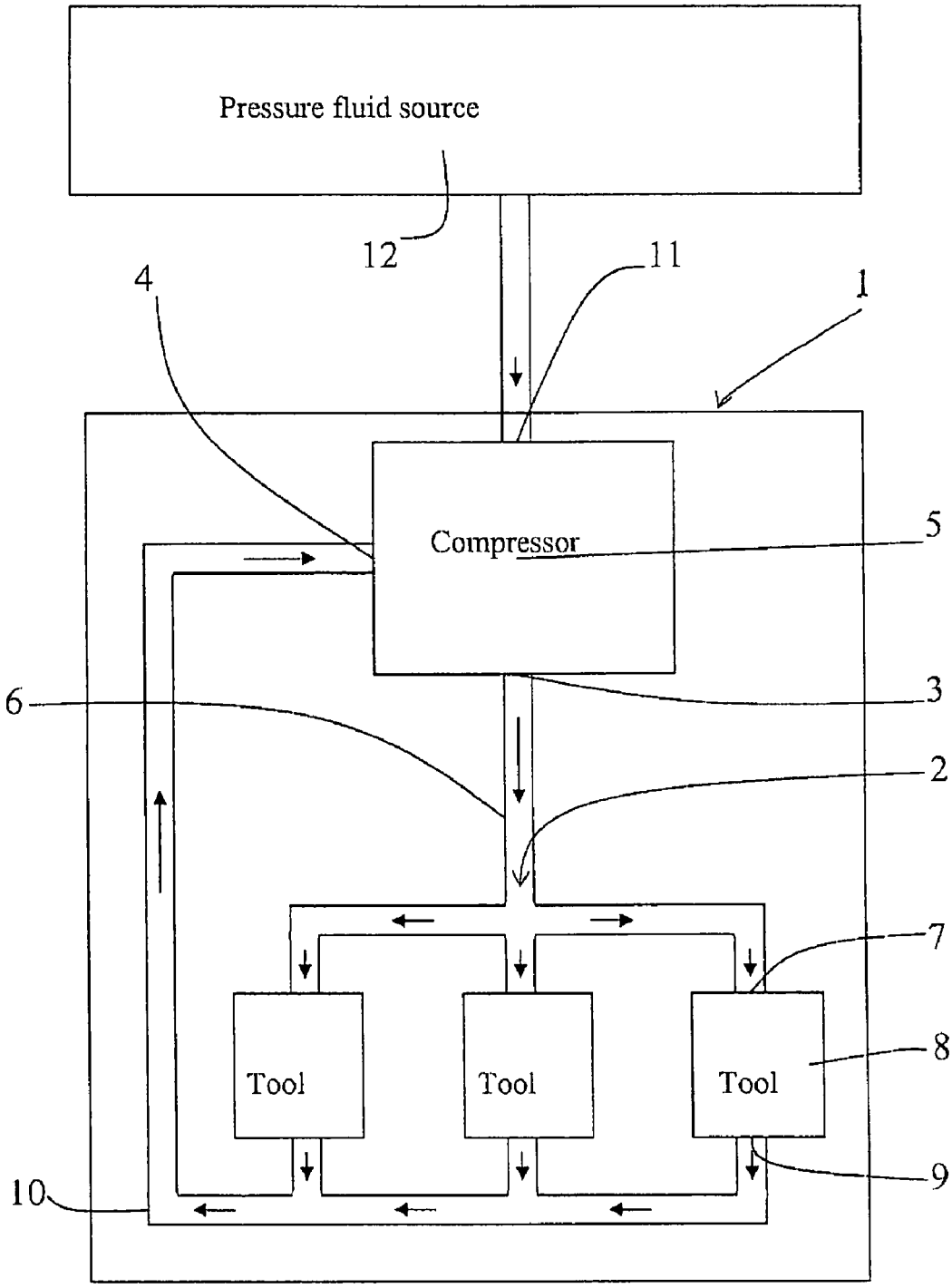
FIG. 1 is a schematic view of a pneumatic circuit of a device according to the invention.

FIG. 1 shows a device 1 with a generally closed pressure fluid circuit 2 which comprises at least one compressor 5, that compresses and pumps fluid with a low compression ratio and a high pressure. The fluid is transported through the compressor 5 from the inlet 4 thereof to the outlet 3 thereof upon compression. The relation between the pressure at the outlet 3 and the pressure at the inlet 4 is, for a certain absolute increase of pressure in the compressor, remarkably low in comparison to contemporary methods/devices, as the pressure at the inlet 4 exceeds the pressure of the surrounding atmosphere, and since contemporary devices operate with an inlet pressure that generally corresponds to the pressure of the surrounding atmosphere. Preferably, the inlet pressure is more than 1,5 times, preferably more than 2,0 times higher than the pressure of the surrounding atmosphere.

The fluid is guided from the compressor 5 through a conduit 6 to an inlet 7 of at least one fluid-operated tool 8. The tool 8 may comprise a reciprocal piston, as in a piston expander or in a pneumatically activated actuator for operating the valves of a combustion engine. Generally, the tool 8 is an engine, a working tool or any other device which is pneumatically operated. The pressure in the conduit 6 is substantially the same at the outlet 3 of the compressor as at the inlet 7 of the tool 8. The fluid is conducted through the tool 8 to an outlet 9 thereof. In the tool 8, the supplied fluid generates a work as it passes through said member to the outlet 9. Through a conduit 10 the outlet 9 is in connection with the inlet 4 of the compressor 5. The work is generated by means of the pressure difference between the fluid in the conduit 6 between compressor and tool and the fluid in the return conduit 10 and/or through the expansion of a fluid from the conduit 6, via the inlet 7, to the conduit 10, via the outlet 9. In the conduit 10, the pressure is generally the same at the outlet 9 of the tool 8 as at the inlet 4 of the compressor 5. Via the return conduit 10, the fluid is returned from the outlet 9 of the tool to the inlet 4 of the compressor 5. Via a further inlet 11 in the compressor 5 or in the return conduit 10, or alternatively, to the conduit 6, fluid is supplied as a complement to the fluid that leaks out of the system. This replacement fluid is taken from the atmosphere or from a reservoir 12, in which the pressure, preferably, is higher than in the surrounding atmosphere.

Figure 2:
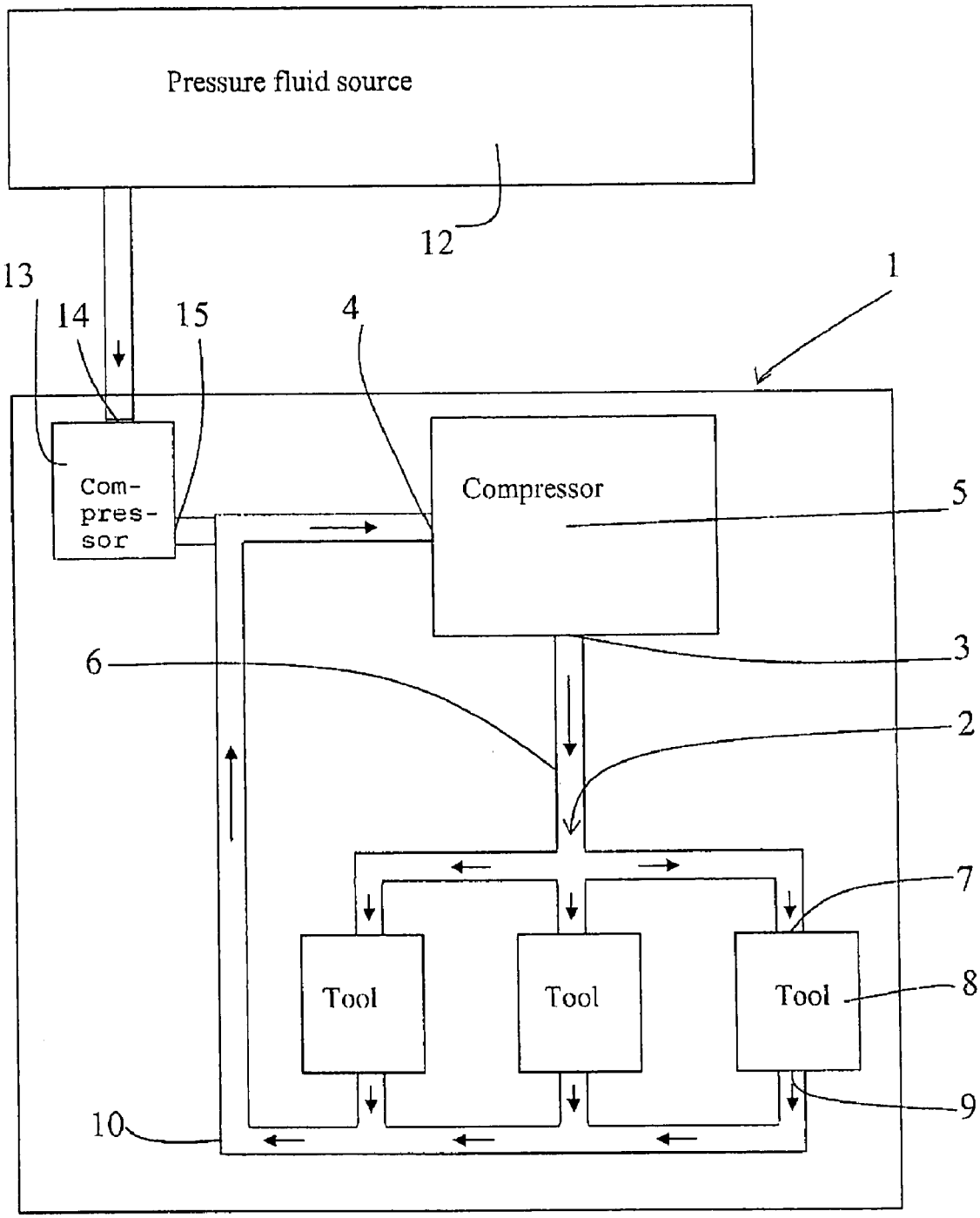
FIG. 2 is a schematic view of a pneumatic circuit of a device according to a second embodiment of the device according to the invention.

FIG. 2 shows an alternative embodiment of the device according to FIG. 1. Besides a first compressor 5, the device according to FIG. 2 also comprises a second compressor 13. The second compressor 13 is applied such that fluid, corresponding to the amount of fluid that leaks out of the system, that is the device 1, is supplied to the first compressor, either indirectly through the return conduit 10 or directly. Through the inlet 14 of the second compressor 13, fluid is sucked from the surrounding atmosphere or from a reservoir 12 and is being conducted through the compressor 13, via an outlet 15, to the first compressor 5, for further compression in the latter.

Figure 3:
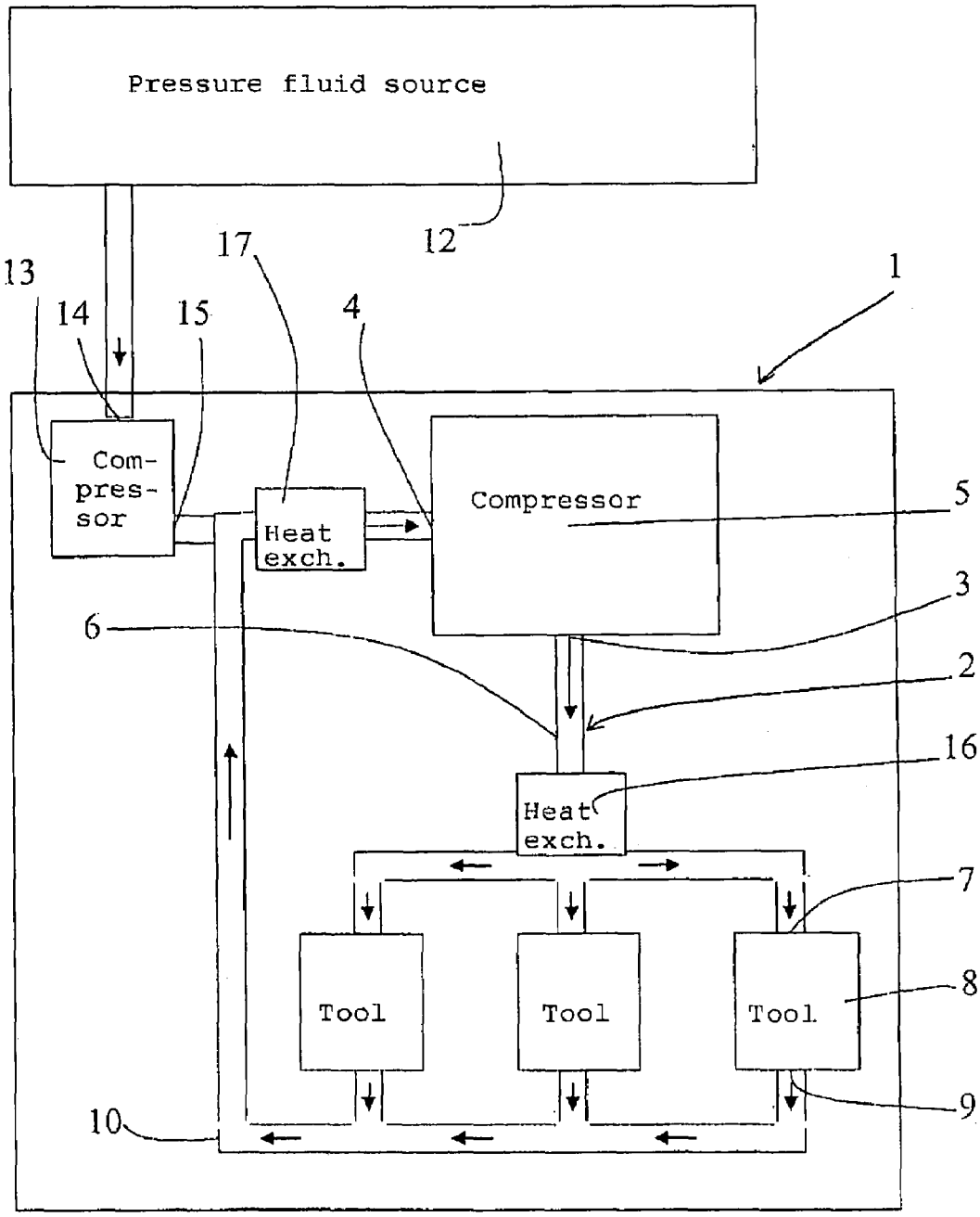
FIG. 3 is a schematic view of a pneumatic circuit of a device according to a third embodiment of the device according to the invention.

FIG. 3 shows an alternative embodiment of FIG. 1 and FIG. 2. The device according to FIG. 3 comprises at least one heat exchanger 16, which has a temperature that is higher than the one of the surrounding atmosphere and by means of which the fluid in the conduit 6 is heated or at least prevented from cooling to the same degree as if only the surrounding atmosphere had been permitted to cool the conduit 6 with its charge of pressure fluid. The device also comprises a heat exchanger 17 that has a temperature that is lower than the one of the surrounding atmosphere or that has an elevated heat conductivity in relation to the surrounding atmosphere and by means of which the fluid in the return conduit 10 is cooled more rapidly than would be the case if only effected by the surrounding atmosphere. The heat supplied to the first heat exchanger 16 and used for the heat exchange may be constituted by waste heat, for example the exhaust gases from a combustion engine or a boiler or from any industrial process. Heat can also be supplied from any other heat source for the purpose of operating the device 1 as a pneumatic energy transformer.

The cooling medium in the second heat exchanger may, for example, be a liquid such as water, having a lower temperature and/or a higher heat capacity than the air of the atmosphere that surrounds the return conduit.

Figure 4:
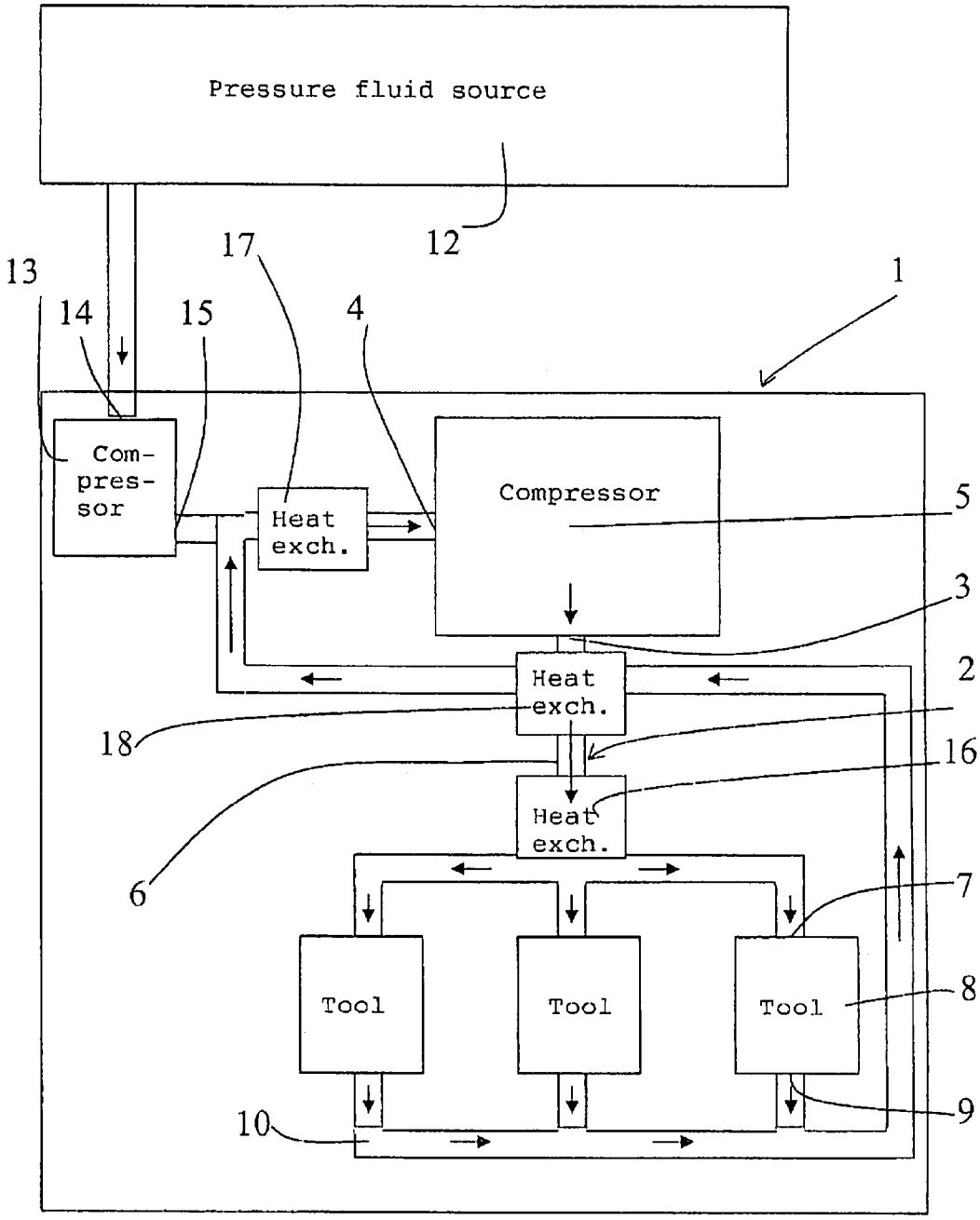
FIG. 4 is a schematic view of a pneumatic circuit of a device according to a fourth embodiment of the device according to the invention.

FIG. 4 shows an alternative embodiment of FIG. 3 in which there is arranged a heat exchanger 18 for the recover of heat from the fluid in the return conduit 10 to the fluid in the conduit 6, said heat exchanger being provided by the conduit 6 between the outlet 3 of the compressor 5 and the inlet 7 of the tool 8. The heat exchanger 18 is arranged in the conduit 6 upstream the site by the conduit at which the first heat exchanger 16 for heat supply is arranged.

According to a specific, preferred embodiment of the invention, the device is provided in connection with a combustion engine. The tool comprises one or more pneumatically, i.e. without camshaft, operated actuators for the inlet and outlet valves of the cylinders of the engine. The first compressor 5 is a piston compressor or a screw compressor. If the engine comprises a compressor for the compression of the air that is to be used together with the fuel by the combustion, this compressor, preferably, forms the second compressor according to the invention. The first heat exchanger is, preferably connected with the exhaust system for the purpose of using hot exhaust gases as a heat exchanging medium.

It should be realized that a plurality of alternatives of the above embodiments of a device according to the invention will be obvious for a person skilled in the art without departing from the scope protection of the invention, as the latter is defined in the enclosed patent claims supported by the description and the annexed drawings.

The invention claimed is:

1. A method for controlling a flow of pressure fluid in a pneumatic device (1) comprising a generally closed pressure fluid circuit (2), at least one compressor (5), for increasing the pressure of the pressure fluid in the circuit, said compressor having an inlet (4) and an outlet (3), a tool (8) driven by the pressure fluid in the circuit, and through which the pressure fluid is transported in the circuit from the outlet (3) to the inlet (4) of the compressor, characterized in that a pressure is generated by the compressor (5) and a load at the tool (8) is controlled such that a return pressure in the circuit exceeding the surrounding pressure of the atmosphere is obtained downstream the tool (8), and in that the circuit comprises a return conduit (10), and in that a second heat exchanger (17) is used for cooling the pressure fluid present in the return conduit.

2. A method according to claim 1, characterized in that a pressure fluid from a pressure fluid source (12) is supplied to the circuit downstream the tool (8) for the compensation of pressure fluid losses in the circuit.

3. A method according to claim 2, characterized in that the circuit comprises a pressure fluid conduit (6) extending from the compressor (5) to the tool (8), and that this conduit is insulated for the purpose of reducing the heat exchange between the pressure fluid and the surrounding.

4. A method according to claim 2, characterized in that the circuit comprises a pressure fluid conduit (6) extending from the compressor (5) to the tool (8), and that heat is supplied to the conduit from an external heat source (16), for the purpose of maintaining or increasing the temperature of the pressure fluid in said conduit.

5. A method according to claim 2, characterized in that the circuit comprises a return conduit (10), and that a second heat exchanger (17) is used for cooling the pressure fluid present in the return conduit.

6. A method according to claim 1, characterized in that the circuit comprises a pressure fluid conduit (6) extending from the compressor (5) to the tool (8), and that this conduit is insulated for the purpose of reducing the heat exchange between the pressure fluid and the surrounding.

7. A method according to claim 6, characterized in that the circuit comprises a pressure fluid conduit (6) extending from the compressor (5) to the tool (8), and that heat is supplied to the conduit from an external heat source (16), for the purpose of maintaining or increasing the temperature of the pressure fluid in said conduit.

8. A method according to claim 6, characterized in that the circuit comprises a return conduit (10), and that a second heat exchanger (17) is used for cooling the pressure fluid present in the return conduit.

9. A method according to claim 1, characterized in that the circuit comprises a pressure fluid conduit (6) extending from the compressor (5) to the tool (8), and that heat is supplied to the conduit from an external heat source (16), for the purpose of maintaining or increasing the temperature of the pressure fluid in said conduit.

10. A method according to claim 9, characterized in that the circuit comprises a return conduit (10), and that a second heat exchanger (17) is used for cooling the pressure fluid present in the return conduit.

11. A device for the pneumatic operation of a tool, comprising a generally closed pressure fluid circuit (2), at least one compressor (5), for increasing the pressure of the pressure fluid in the circuit, said compressor (5) having an inlet (4) and an outlet (3), a tool (8) driven by the pressure fluid in the circuit, and through which the pressure fluid is transported in the circuit from the outlet (3) to the inlet (4) of the compressor (5), characterized in that the pressure generated by the compressor (5) and the load adopted by the tool (8) are adapted such that a return pressure of the pressure fluid downstream the tool (8) is higher than the pressure of the surrounding atmosphere, and in that it comprises a heat exchanger arranged by the return conduit (10) for the purpose of cooling the pressure fluid in the return conduit (10).

12. A device to claim 11, characterized in that it comprises a pressure fluid source (12), through which the pressure fluid is conducted to an inlet of the compressor (5), the pressure in the pressure fluid source (12) being higher than the pressure in the return conduit (10).

13. A device according to claim 12, characterized in that it comprises a heat exchanger (16), by means of which heat is exchanged between the pressure fluid in the circuit downstream the compressor (5) and upstream the tool (8) and an external heat source.

14. A device according to claim 12, characterized in that it comprises a heat exchanger arranged by the return conduit (10) for the purpose of cooling the pressure fluid in the return conduit (10).

15. A device according to claim 11, characterized in that it comprises a heat exchanger (16), by means of which heat is exchanged between the pressure fluid in the circuit downstream the compressor (5) and upstream the tool (8) and an external heat source.

16. A device according to claim 15, characterized in that the device is provided at combustion engine and that the heat source comprises a fluid or a body heated by the combustion engine.

17. A device according to claim 15, characterized in that it comprises a heat exchanger arranged by the return conduit (10) for the purpose of cooling the pressure fluid in the return conduit (10).

* * * * *